US007762429B2

(12) United States Patent
Macler et al.

(10) Patent No.: US 7,762,429 B2
(45) Date of Patent: Jul. 27, 2010

(54) PORTABLE WATER COOLER FOR USE WITH BAGGED FLUIDS AND BAGGED FLUIDS FOR USE THEREWITH

(75) Inventors: Henry Macler, Monroe, LA (US); Jeffrey Macler, Texumseh, MO (US); Steven Avery, South Jordan, UT (US)

(73) Assignee: International Packaging Innovations, LLC, St. Louis, MO (US)

( * ) Notice: Subject to any disclaimer, the term of this patent is extended or adjusted under 35 U.S.C. 154(b) by 191 days.

(21) Appl. No.: 11/421,021

(22) Filed: May 30, 2006

(65) Prior Publication Data

US 2006/0201966 A1 Sep. 14, 2006

Related U.S. Application Data

(63) Continuation of application No. 10/926,604, filed on Aug. 25, 2004, now Pat. No. 7,165,700.

(60) Provisional application No. 60/497,530, filed on Aug. 25, 2003, provisional application No. 60/545,155, filed on Feb. 17, 2004.

(51) Int. Cl.
*B67D 1/00* (2006.01)

(52) U.S. Cl. ..... 222/83.5; 222/94; 222/105; 222/146.6; 222/183; 222/185.1

(58) Field of Classification Search ..... 222/83, 222/81, 83.5, 105, 130–131, 146.6, 183, 222/185.1, 386, 386.5, 286, 286.5
See application file for complete search history.

(56) References Cited

U.S. PATENT DOCUMENTS 1,316,122 A * 9/1919 Vall ..... 222/88

(Continued)

FOREIGN PATENT DOCUMENTS

CA 1229073 8/1985

(Continued)

OTHER PUBLICATIONS

Webpage—http://www.concessionstands.com/itemdesc.asp?CartId=8002691GSS-EVEREST-VO750 . . . ,JARCO: Server Express Rectangular Stainless, Model 07020, p. 1-2, Oct. 22, 2004.

(Continued)

*Primary Examiner*—Kevin P Shaver
*Assistant Examiner*—Andrew P Bainbridge
(74) *Attorney, Agent, or Firm*—Lewis, Rice & Fingersh, L.C.

(57) ABSTRACT

A portable water cooler is designed to accept the placement of bagged fluid therein, leading to the connection of the bag of fluid to a fluid flow pathway, thereby allowing the fluid to be dispensed in a manner such that the fluid is segregated from the internal surfaces of the cooler. The portable water cooler generally includes an internal spike and external spigot through which fluid may flow. Systems and methods for dispensing bagged fluid from such a cooler, including various multi-bag systems and methods allowing for improved thermal control of fluids being dispensed, as well as increased selection of fluids dispensed from the same portable water cooler provide a high level of convenience.

9 Claims, 7 Drawing Sheets

U.S. PATENT DOCUMENTS

| | | | | | |
|---|---|---|---|---|---|
| 1,364,889 | A | | 1/1921 | Rupp | |
| 1,889,557 | A | | 4/1932 | Lange | |
| 2,655,286 | A | | 10/1953 | Barbaro | |
| 3,152,729 | A | * | 10/1964 | Piker | 222/131 |
| 3,232,491 | A | * | 2/1966 | Hunt | 222/154 |
| 3,239,104 | A | | 3/1966 | Scholle | |
| 3,343,719 | A | * | 9/1967 | Kastamo et al. | 222/1 |
| 3,422,992 | A | * | 1/1969 | Brooks et al. | 222/80 |
| 3,435,990 | A | * | 4/1969 | Pike, Jr | 222/1 |
| 3,587,934 | A | * | 6/1971 | Elmore | 222/171 |
| 3,589,862 | A | * | 6/1971 | Veloz | 222/386.5 |
| 3,613,872 | A | * | 10/1971 | Donnelly | 206/545 |
| 3,688,950 | A | | 9/1972 | Parish | |
| 3,813,009 | A | | 5/1974 | Lenz | |
| 3,837,533 | A | * | 9/1974 | Splan | 222/94 |
| 3,848,776 | A | | 11/1974 | Schiesser | |
| 4,162,029 | A | * | 7/1979 | Gottsegen et al. | 222/131 |
| 4,318,497 | A | * | 3/1982 | Friedrich | 222/83 |
| 4,516,693 | A | * | 5/1985 | Gaston | 222/105 |
| 4,527,716 | A | | 7/1985 | Hass et al. | |
| 4,557,406 | A | * | 12/1985 | Olinger et al. | 222/564 |
| 4,561,560 | A | | 12/1985 | Lyon | |
| 4,755,292 | A | * | 7/1988 | Merriam | 210/192 |
| 4,796,785 | A | * | 1/1989 | Merritt | 222/131 |
| 4,801,007 | A | | 1/1989 | Rule | |
| 4,846,236 | A | | 7/1989 | Deruntz | |
| 4,865,218 | A | | 9/1989 | Derby et al. | |
| 4,921,135 | A | * | 5/1990 | Pleet | 222/82 |
| D309,396 | S | * | 7/1990 | Lundblade et al. | D7/313 |
| 5,141,134 | A | | 8/1992 | Machado | |
| 5,163,587 | A | * | 11/1992 | Apps et al. | 222/105 |
| 5,224,619 | A | | 7/1993 | Dilworth et al. | |
| 5,281,027 | A | | 1/1994 | Thrall | |
| 5,405,053 | A | | 4/1995 | Zublin | |
| D361,838 | S | | 8/1995 | Kuhn et al. | |
| 5,551,606 | A | | 9/1996 | Rai et al. | |
| 5,567,322 | A | | 10/1996 | Rundle et al. | |
| 5,573,047 | A | * | 11/1996 | Akin | 141/330 |
| 5,645,913 | A | * | 7/1997 | Rogers | 428/77 |
| 5,691,015 | A | | 11/1997 | Tsukamoto et al. | |
| 5,944,232 | A | | 8/1999 | Hestehave et al. | |
| 5,967,197 | A | | 10/1999 | Shown | |
| 5,967,322 | A | * | 10/1999 | Apps et al. | 206/497 |
| 5,971,218 | A | * | 10/1999 | Le | 222/185.1 |
| 6,019,196 | A | * | 2/2000 | Selby et al. | 184/1.5 |
| 6,026,988 | A | | 2/2000 | Teetsel, III et al. | |
| 6,053,401 | A | * | 4/2000 | Andrews, Sr. | 229/117.3 |
| 6,095,433 | A | | 8/2000 | Langdon | |
| 6,098,844 | A | * | 8/2000 | Nicolle | 222/80 |
| 6,116,467 | A | * | 9/2000 | Petriekis et al. | 222/105 |
| 6,149,034 | A | | 11/2000 | Amberg et al. | |
| 6,207,046 | B1 | | 3/2001 | Yamashita et al. | |
| 6,223,940 | B1 | | 5/2001 | Quinn | |
| 6,364,329 | B1 | * | 4/2002 | Holub et al. | 280/47.26 |
| 6,398,073 | B1 | * | 6/2002 | Nicolle | 222/67 |
| 6,442,960 | B1 | | 9/2002 | Fournier et al. | |
| 6,557,735 | B1 | | 5/2003 | Stray | |
| 6,820,771 | B2 | * | 11/2004 | Lassota et al. | 222/185.1 |
| 7,165,700 | B2 | * | 1/2007 | Macler et al. | 222/83 |
| 2006/0052747 | A1 | * | 3/2006 | Nishimura et al. | 604/85 |
| 2006/0144857 | A1 | * | 7/2006 | Last | 222/105 |

FOREIGN PATENT DOCUMENTS

| | | | |
|---|---|---|---|
| CA | 1192164 | | 11/1987 |
| CN | 98213085.6 | | 6/1999 |
| CN | 98215283.3 | | 7/1999 |
| CN | 99209220.5 | | 4/2000 |
| CN | 99246066.2 | | 9/2000 |
| CN | 99246067.0 | | 9/2000 |
| CN | 99254569.2 | | 2/2001 |
| CN | 00237624.5 | | 5/2001 |
| CN | 00237625.3 | | 7/2001 |
| CN | 03209721.2 | | 8/2004 |
| CN | 03231908.8 | | 8/2004 |
| CN | 03231906.1 | | 9/2004 |
| CN | 03210115.5 | | 10/2004 |
| CN | 200320100534.9 | | 3/2005 |
| CN | 200410052994.8 | | 3/2005 |
| CN | 200410067280.4 | | 3/2005 |
| CN | 200420005755.2 | | 3/2005 |
| CN | 20420037745.7 | | 7/2005 |
| CN | 200420107401.9 | | 11/2005 |
| EP | 0 250 640 | A1 | 1/1988 |
| EP | 0250640 | | 1/1988 |
| FR | 2685293 | | 6/1993 |

OTHER PUBLICATIONS

Webpage—http://www.sealedair.com/library/casehit/rtm_rest.html, RTM Restaurant Group—Cryovac Division of Seal Air Case History, p. 1-5, Oct. 22, 2004.

Webpage—http://pelv2003.packexop.com/pelv2003/packaging_suppliers/ve/pr/33953/970.html, Sealed Air Corporation, Cryovac to Showcase the Advantage and Efficiencies for Flexible Packaging at IEFP Booth #E7612, p. 1-3, Oct. 22, 2004.

Webpage—http://www.server-products.com/sepouch.htm, Codiment Pumps—Server Express System, p. 1-3, Oct. 22, 2004.

* cited by examiner

PORTABLE WATER COOLER FOR USE WITH BAGGED FLUIDS AND BAGGED FLUIDS FOR USE THEREWITH

CROSS REFERENCE TO RELATED APPLICATIONS

This application is a Continuation of and claims priority to U.S. patent application Ser. No. 10/926,604 filed Aug. 25, 2004 and now issued as U.S. Pat. No. 7,165,700 on Jan. 23, 2007 which in turn claims the benefit of U.S. Provisional Patent Applications Nos. 60/497,530, filed Aug. 25, 2003, and 60/545,155, filed Feb. 17, 2004. The entire disclosures of all of these applications are herein incorporated by reference.

BACKGROUND OF THE INVENTION

1. Field of Invention

The invention generally relates to systems and methods for carrying and dispensing liquids. More particularly, the invention relates to a container and spike combination for holding and accessing a sealed flexible bag containing fluid and thereby allowing the dispensing of the fluid.

2. Description of Related Art

Fluid storage devices and dispensers are used in all sorts of human activities. In one embodiment they are used to transport beverages, particularly for human consumption, to locations where other means of obtaining beverages would be impossible or, at least, inconvenient. Commonly such a container will be filled with fluid and taken along in instances such as when a person travels for recreation, including going to an undeveloped area to hike, to a park for a picnic, to the beach, or to participate in or observe an athletic event. Principally, the containers are used to carry fluid for drinking to decrease the danger of dehydration and heat exhaustion and related injury when outdoors, and also merely for comfort when one becomes thirsty. Quite often the fluid storage device is designed to embody thermal insulating properties for maintaining the temperature of the fluid significantly above or below the ambient temperature.

In addition to personal uses such as those mentioned above, insulating fluid containers may have public uses. They may be used to sanitarily dispense beverages in food service establishments or the like, and therefore regularly are seen in concession stands, buffet lines, or similar types of locations where storage and dispensing of prepared drinks is desirable but where more permanent structures are not useable. Such containers are regularly filled with water and other fluids or drinks such as coffee, tea, soft drinks, fruit juices, or the like. Further, insulating fluid containers are not limited to carrying beverages but may also be used to transport non-potable fluids.

The insulating fluid containers described herein include those generally referred to by use of the terms "water cooler" or simply "cooler", "water jug", and "Thermos™". For the purposes of this disclosure, the term "portable water cooler" is chosen since it is fairly descriptive of the device being discussed. A portable water cooler will generally be transportable by one or more persons without the assistance of machines, although some embodiments will require a machine to lift or carry (for instance the water cooler may be mounted on a large trailer). A portable water cooler will generally not be a system designed for purposeful use only in a single location, but a portable water cooler may be "built in" and adapted for single-location use. A portable water cooler generally serves as a storage container for the fluid there inside. That is, the fluid generally is not placed in the cooler from an external storage tank for the purpose of cooling or heating prior to dispensing. Also, a portable water cooler generally includes an integral spigot or valve for the dispensing of the liquid contained therein to a drinking container such as a cup or directly to a user's mouth. It is generally not intended that the fluid in the portable water cooler be dispensed to a storage reservoir from which it is then dispensed. The water cooler is generally constructed, in part, of an insulative material, or has a built-in cooling or heating system to control the temperature of its contents. Rubbermaid Corporation makes a variety of such portable water coolers. Devices such as the military's "water buffaloes" also fall within the scope of devices herein termed portable water coolers. A majority of portable water coolers used for fluid transport and dispensing are constructed with materials such as stainless steel, glass, and plastics, or some combination thereof, that give the portable water coolers a rigid form.

While there are many types of portable water coolers available in the market, many suffer from similar problems. A portable water cooler is generally in the shape of a hollow upright box or cylinder which encloses the fluid and prevents it from escaping the container. Fluid is generally added from above by removing the top panel of, or opening an access point in, the cooler and placing the fluid directly against the interior walls of the cooler inside the hollow interior. The lid or a cap is then replaced. In some portable water coolers, the lid seals the fluid inside the container, while in others the lid may partially seal the container but the fluid can knock the lid loose and escape if the container is tipped from upright. Fluid is dispensed through the use of a spigot or valve often located towards the bottom of the fluid holding area of the cooler. The spigot is generally a manually operated structure having a moveable valve. The valve is placed in a hole which extends through the outer structure of the portable water cooler connecting the hollow interior to the external world. When the valve is opened, the weight of the fluid in the portable water cooler forces fluid at the bottom of the cooler through the hole, where it is generally dispensed in a stream to a user generally holding a smaller beverage container thereunder.

Alternatively, smaller water coolers may include the spigot or valve in a different arrangement to allow a user to directly drink from the portable water cooler. These may include straws, spigots, or even just holes where fluid is allowed to flow from the hollow interior of the portable water cooler to the user. Some of these devices require the user to open them prior to drinking (generally to prevent spills), while others may place the hole on the top of the container so that the user has to tip the portable water cooler (generally into their mouth) to get the fluid out. In almost all cases, the fluid is dispensed under the force of gravity by simply allowing the fluid to pass through a hole in the outer structure of the portable water cooler when the fluid is being dispensed. The walls, base, and lid of the cooler are generally constructed of insulative materials (often various foamed resins) to provide that the temperature of the enclosed fluid is better maintained over time when that temperature is different from the ambient temperature.

While these portable water coolers have many beneficial uses, they also have clear disadvantages, including susceptibility to contamination from various sources. For instance, while the portable water cooler is being filled, dust or particulates may be introduced into the fluid as the fluid is added to the cooler. Further, in many coolers, the lid is not necessarily placed on the cooler when it is in use. If the cooler is undergoing particularly heavy use, the lid may be left off to allow rapid refilling. This can allow the introduction of foreign matter. Because the fluid is in direct contact with the sides of the portable water cooler, if the cooler is not regularly cleaned (which may not always be possible), buildup of contaminants can result in the growth of biofilms or other microorganisms which could potentially be toxic to those drinking the fluid.

When the coolers are used to dispense fluids, the inside surfaces of the cooler can become contaminated with particles of the fluid or items suspended in the fluid. An example of such contamination of the container occurs when a dissolved powdered soft drink mix is held within the container. Powdered soft drink mixes come in a variety of forms and under a variety of trade names but generally are designed to add concentrated flavoring and/or coloring to water to improve taste or appearance. Many soft drink mixes also include concentrated vitamins, minerals or other enhancers to improve the nutritional content of the soft drink mix as compared with plain water. Many soft drink mixes also include granulated sugar to improve taste. These soft drink mixes are added to water in which they dissolve or are suspended. When a soft drink and water mixture is placed in contact with the interior walls of the container these wall surfaces can adsorb fluid components. Due to such interaction between the fluid and the container or due to other causes, tastes and odors from the soft drink mix can permeate the fluid container. This contamination can cause a significant negative impact on the taste of beverages later dispensed from the container. In a specific instance a grape flavoring contaminating the portable fluid container can be partially transferred to later added ice tea, creating an unpleasant grape-tea combination.

Such container contamination can be particularly problematic when caused by beverages having a strong tastes and odors such as coffee. Sometimes, a strongly flavored beverage can so impregnate the container walls, that its scent or taste cannot be removed even with a thorough cleaning. This can prevent a portable fluid container from being reused with other flavors of fluids, and can even require the container's destruction if the flavor interference is too great for a particular use. Adsorption or other causes of contamination can also make the container unsanitary for future use regardless of flavor.

Another disadvantage of portable water coolers is related to their ability to maintain the desired temperature of the fluid held therein. Most portable water coolers utilize insulation as opposed to heating or cooling mechanisms to provide for lighter weight, decreased cost, and improved portability as there is no reliance on power sources. These can, however, have problems maintaining colder or hotter temperature fluids over time. For maintaining cold beverages, the insulative coolers capabilities are often supplemented by including ice in the fluid. The inclusion of ice, however, has various problems. If the fluid is flavored, either the ice must also be flavored (which can be a difficult and time consuming task to perform and can result in dispensing problems) or the flavor of the fluid will slowly be diluted by the ice which can produce an unpleasant tasting result. Some coolers have tried to avoid this issue by including separate ice holders or the like to separate the melting ice from the fluid. While these have limited success at cooling compared to the direct inclusion of ice, they also lead to a decrease in the amount of consumable fluid held in the device which requires larger and less manageable portable water coolers to be used for the same tasks.

SUMMARY OF EMBODIMENTS OF THE INVENTION

In accord with the above discussion and for reasons understood to those of ordinary skill in the art, there is discussed herein a portable water cooler designed to accept the placement of bagged fluid therein, leading to the connection of the bag to a fluid flow pathway, thereby allowing the fluid to be dispensed in a manner such that the fluid is segregated from the internal structure of the cooler. There are also included systems and methods for dispensing bagged fluid from such a cooler, including various multi-bag systems and methods allowing for improved thermal control of fluids being dispensed, as well as increased selection of fluids dispensed from the same portable water cooler. Further disclosed are methods for preparing fluids in a bag for use with such a cooler.

An embodiment of the invention provides an apparatus for dispensing a fluid comprising a portable water cooler having a hollow body that has thermally insulating properties and an internal volume within the hollow body, a fluid flow pathway connecting the internal volume to the space external to the hollow body, and a flexible bag containing fluid and positioned in the internal volume. The fluid flow pathway includes a spike having at least one opening into which fluid can flow, the spike being positioned adjacent to the interior volume, a spigot positioned external to the hollow body, and an enclosed channel connecting the spike to the spigot. In this embodiment, the bag contains sufficient fluid that when the bag is placed in the cooler, the weight of the fluid in the bag causes the spike to penetrate through a wall of the bag, allowing the fluid in the bag to flow into the at least one opening and through the enclosed channel to the spigot. In alternate embodiments, the hollow body of the apparatus has a rigid form or is constructed of pliable materials. The spike may be comprised of a shaft and a blade. The shaft portion of the spike may be hollow and generally cylindrical. The blade portion of the spike may be conical, including the conical point. Such a conical blade may be a right circular cone having an angle of expansion in the range of about 30 to about 60 degrees. The bag may be constructed of a single ply of polyethylene having a thickness in the range of about 3 to about 4 mil. At least a portion of the fluid flow pathway may be repeatably removable and replaceable. The apparatus may further comprise at least one additional flexible bag containing a fluid and positioned in the internal volume. In alternate embodiments the fluid in an additional bag may be frozen or may be positioned such that after fluid from another flexible bag has been dispensed, the wall of the additional bag will be penetrated by the spike. The apparatus may comprise a means to increase the pressure in the internal volume.

Further, an embodiment of the invention simply provides a portable water cooler essentially as described above, in which the hollow body may take a shape that is generally that of a cylinder that is closed on the first of two ends, and may be open on the second of the two ends, and may have a repeatably removable lid that can be positioned at the open second end so as to enclose the internal volume. The internal volume may be in the range of about 2 to about 10 gallons.

Generally, an embodiment provides an apparatus for dispensing fluid comprising a portable, thermally insulating means for supporting a sealed bag of fluid, a means for dispensing fluid from the bag of fluid connected to the means for supporting, and a means for breaching a wall of the bag, the means for breaching sealing the bag to the means for dispensing such that fluid from the bag of fluid is dispensed from the bag only through the means for dispensing.

A further embodiment provides an apparatus for dispensing a fluid including a portable water cooler comprising a hollow body having thermally insulating properties, an internal volume within the hollow body, a fluid flow pathway connecting the internal volume to the space external to the hollow body, a flexible bag containing fluid that is positioned in the internal volume, the bag having attached thereto a fitment. The fluid flow pathway comprises a fitting element having at least one opening into which fluid can flow, a spigot positioned external to the hollow body, and an enclosed channel connecting the fitting element to the spigot. In such an embodiment, the connection of the fitting element of the fluid flow pathway to the fitment attached to the bag allows the fluid in the bag to flow into the at least one opening and through the enclosed channel to the spigot.

DESCRIPTION OF PREFERRED EMBODIMENT(S)

Figure 1:
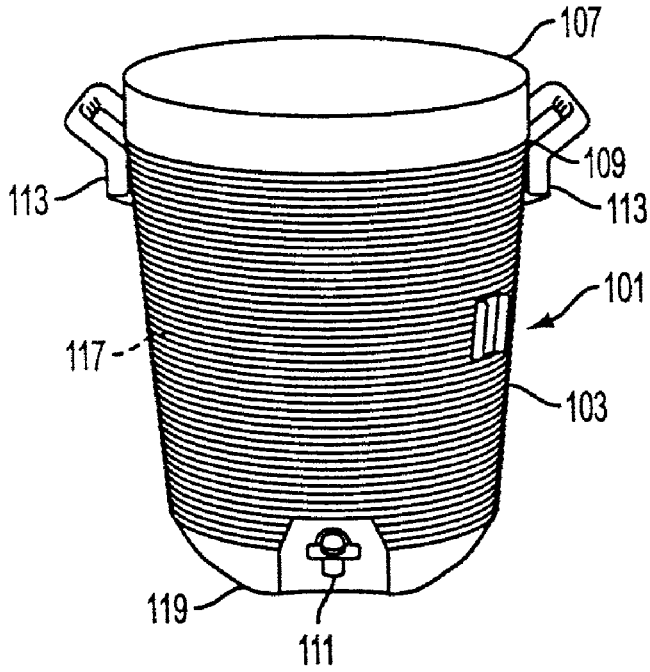
FIG. 1 provides a front perspective view of an embodiment of a portable water cooler.
Figure 2:
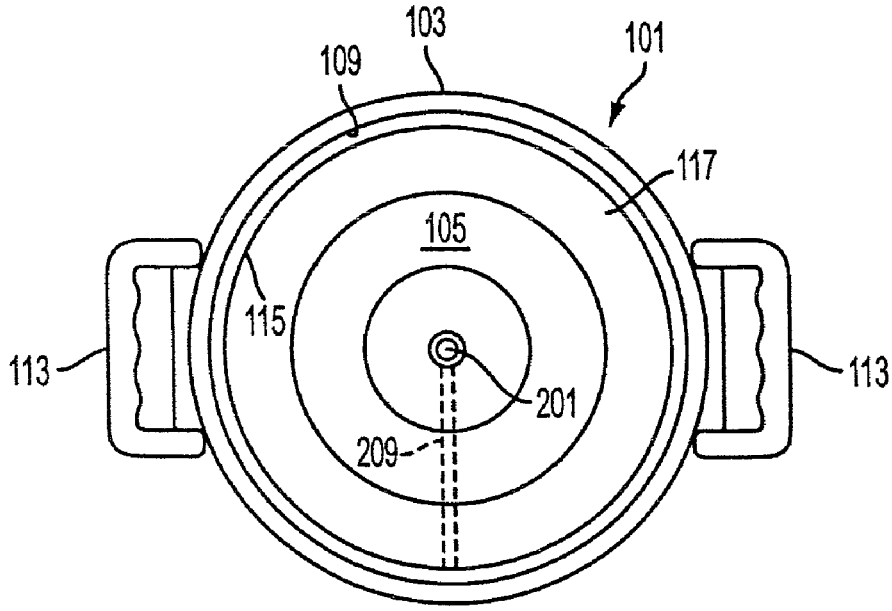
FIG. 2 provides a top-side elevation view of the embodiment of FIG. 1 with the lid of the portable water cooler removed to show internal structure.

FIGS. 1 and 2 illustrate a first embodiment of a portable water cooler (101) designed for use with bagged fluids. The portable water cooler (101) generally comprises a hollow body (103) that defines an internal volume (117) that may be used to contain a fluid. In the depicted embodiment, the interior of the hollow body (103) has a bottom end (105) and side walls (115), which in combination form the boundaries of an internal volume (117). In this embodiment the hollow body (103) is generally in the shape of an upright cylinder having a closed bottom face (119). Alternative embodiments may use parallelepiped designs or designs having other shapes that define an internal volume (117) that may be used to contain a fluid. The hollow body (103) depicted is generally constructed of a durable and fairly rigid material, such as a plastic material, and may be constructed of several layers, including a foam layer or vacuum layer for insulation. The portable water cooler (101) has a lid (107) used to enclose the internal volume (117). Additionally, the depicted portable water cooler (101) has a fluid flow pathway (200) that comprises a spike (201), an enclosed channel (209), and a spigot (111) through which fluid contained in the internal volume (117) can be dispensed. The portable water cooler (101) preferably will serve as a temperature insulator for substances placed inside the hollow body (103).

The internal volume (117) is enclosed by a lid (107) that is designed to be removeably positioned at the upper end (109) of the hollow body (103). The lid (107) may rest on the upper end (109) of the hollow body (103) or may be attached to the hollow body (103) by any type of connection, such as screw threads, a compression ring, or any other connecting method. In a still further embodiment, the two pieces are simply shaped so as fit tightly together by friction when compressed together. Generally, when the lid (107) is removed, the internal volume (117) is easily accessible. When the lid (107) is in place at the upper end (109) of the hollow body (103), the internal volume (117) is preferably separated from the ambient environment exterior to the portable water cooler (101), as is any substance within the internal volume (117). In an embodiment, the positioning of the lid (107) at the upper end (109) of the hollow body (103) may serve to help prevent the loss of fluid from within the hollow body (103), particularly in the event that the portable water cooler (101) is tilted from the upright position shown in FIG. 1. Note that while the internal volume (117) of the embodiment shown in FIG. 1 is designed to hold a maximum volume of fluid of about 5 gallons, this volume capacity is by no means required; and the portable water cooler (101) can be designed to hold any maximum volume, including maximum volumes from a milliliter or less up to tens of gallons.

Figure 6:
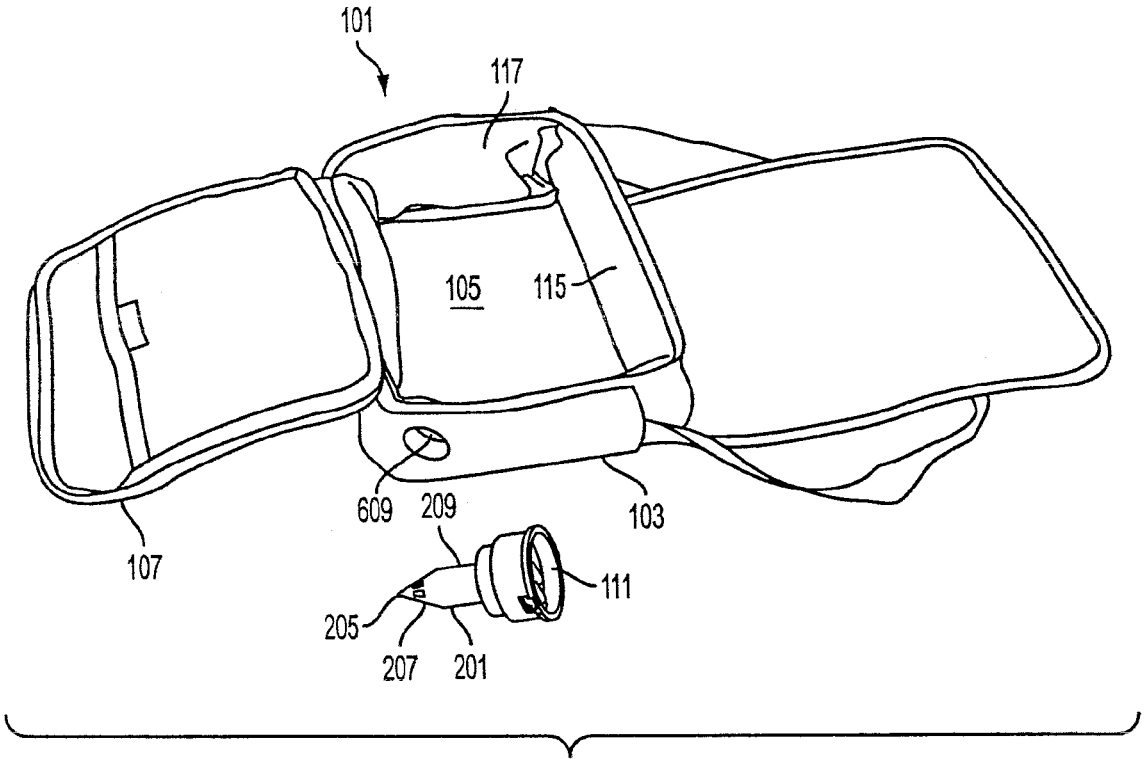
FIG. 6 shows a perspective view of an embodiment of a flexible portable water cooler.

In an alternate embodiment, the portable water cooler (101) is constructed of generally flexible or pliable materials, as is discussed in Provisional Patent Application No. 60/545,155, which is incorporated herein by reference. While "coolers" constructed of flexible materials are commonly known, they are generally not known to be used to hold fluids. The use of bagged fluids as described herein enhances the utility of flexible coolers for use in carrying and dispensing fluids. FIG. 6 shows an embodiment of a portable water cooler (101) constructed of generally flexible or pliable materials. The portable water cooler (101) generally comprises a hollow body (103) that defines an internal volume (117) that may be used to contain a bagged fluid. In the depicted embodiment, the interior of the hollow body (103) has a bottom end (105) and side walls (115), which in combination form the boundaries of an internal volume (117). In this embodiment the hollow body (103) is generally in the shape of a parallelepiped. Alternative embodiments may use cylindrical designs or designs having other shapes that define an internal volume (117) that may be used to contain bagged fluid.

In a further alternate embodiment, whether generally rigid or flexible, the hollow body (103) may include heating or cooling elements as components of the walls or base to provide for improved temperature control of items placed within the hollow body (103).

In the embodiment depicted in FIG. 1, there is included on the exterior surface of the portable water cooler (101) at least one handle (113). A handle (113) is an optional component, but may be supplied to help with movement of the portable water cooler (101). Shown in FIG. 1 are two handles (113), but that number is by no means required. In further embodiments, a handle (113) may be located anywhere on the external surface, and may be repeatably removable or moveable between different positions to facilitate transport.

On the outside of the portable water cooler (101) embodiment of FIG. 1 there is made accessible a spigot (111), which allows for dispensing of the fluid contained within the portable water cooler (101). The spigot (111) may be of any valve design convenient for dispensing fluid on demand, but will generally be a simple push button type valve that defaults to a closed position (through use of a spring or similar biasing mechanism), and is opened only when a push button is depressed.

In the various alternate embodiments discussed herein, the elements of the fluid flow pathway (200) may be difficult to distinguish from one another and may be somewhat overlapping. For instance, the spike (201) and the enclosed channel (209) may be simply adjacent portions of a single length of tubing. As an example, see the fluid flow pathway (200) of the embodiment shown in FIG. 6, where the spike (201) and enclosed channel (209) portions are portions of a single, relatively short length of tubing, and it is somewhat arbitrary where it is determined one ends and the other begins. In an alternate embodiment, the enclosed channel (209) may be defined by the structure of the hollow body (103) as a channel therethrough, and may not have an independent wall structure of its own. Regardless, the channel (209) is enclosed in most embodiments so that where there is fluid in the channel (209), reduced pressure at one end of the channel (209) would result in fluid flow through the channel (209), and so that fluid cannot freely flow from the channel (209) under such pressure differential without the spigot (111) being open.

Figure 3:
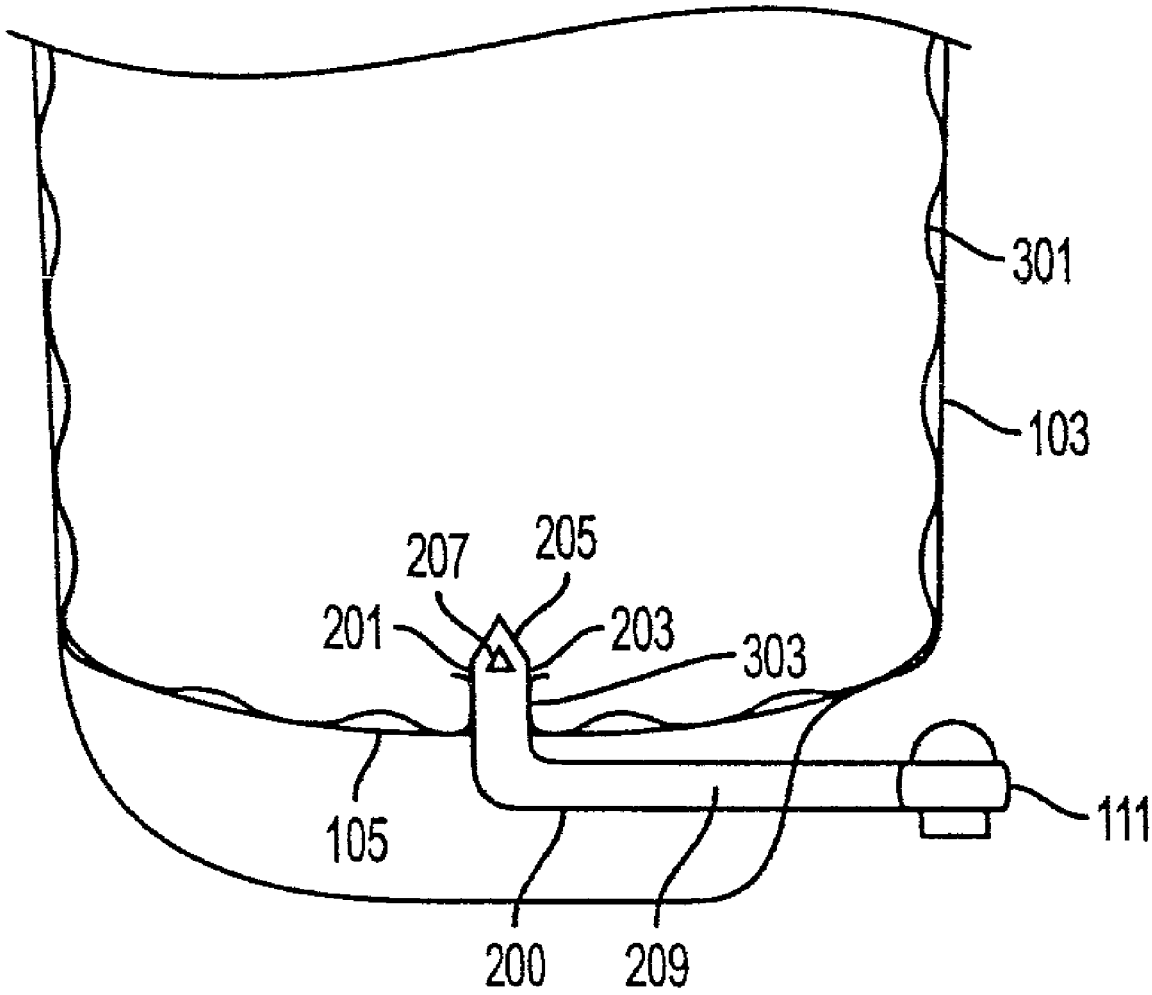
FIG. 3 provides a cross-sectional view of an embodiment of a portable water cooler generally showing the spiking and dispensing mechanisms.

FIGS. 2 and 3 provide for views of the internal volume (117) of the embodiment of FIG. 1, and better illustrate the dispensing of fluid in an embodiment such as is shown in FIG. 1. In the embodiments shown (FIGS. 1-3), to dispense fluid from inside the portable water cooler (101) through the spigot (111) makes use of a fluid flow pathway (200) that includes a spike (201) that projects into the internal volume (117) and that is connected to the spigot (111) by an enclosed channel (209). In the depicted embodiment, the spike (201) is attached to the bottom end (105) of the portable water cooler (101) and extends generally perpendicularly into the internal volume (117) from the bottom end (105). The spike (201) of this embodiment comprises a hollow, generally cylindrical shaft (203) tipped with a pointed blade (205). At least one of the blade (205) and the shaft (203) includes at least one, and generally a plurality, of holes (207) that connects the hollow interior of the shaft (203) with the internal volume (117) of the portable water cooler (101). The shaft (203) is connected to the enclosed channel (209) which in turn connects to the spigot (111), thereby creating an enclosed fluid flow pathway (200) through which fluid can be dispensed from the internal volume (117) out through the spigot (111).

An embodiment of the invention may be constructed new, wherein, for example, the portable water cooler (101) is manufactured to include as part of its permanent structure a channel (209), spigot (111), and spike (201), or is manufactured to mate with a specified channel (209), spigot (111), and spike (201). Alternatively, an embodiment can be constructed by retrofitting an existing cooler to include a fluid flow pathway (200) capable of dispensing bagged fluid. Where a cooler is retrofitted, the channel (209) may attach to an already present spigot (111), though in some embodiments none of the fluid flow pathway (200) components will be present prior to the retrofit. Whether constructed new or retrofitted, the portable water cooler system will operate in a similar manner. Further, in either a new construction or a retrofit, the fluid flow pathway (200) may be a permanent component of the portable water cooler (101) or may be designed to be removable and replaceable at will, in whole or in part.

Generally, fluid is made available to be dispensed through the fluid flow pathway (200) by placing the fluid in the internal volume (117). Fluid can be placed in the internal volume (117) directly, such as by pouring a fluid into the internal volume (117), but preferably the fluid is contained in another structure (generically termed a fluid containing structure) that is placed within the internal volume (117) to which the fluid flow pathway (200) connects. For instance, for embodiments such as shown in FIGS. 1-3, in which the fluid flow pathway (200) includes a spike (201), channel (209), and spigot (111), the connection between the fluid in a fluid containing structure and the fluid flow pathway (200) may be made when the spike (201) is made to project into the fluid containing structure by penetrating the outer wall of the fluid containing structure. In an embodiment as in FIGS. 1-3, whether or not a fluid containing structure is used, when the spigot (111) is closed, the fluid generally is held in the fluid flow pathway (200) by the valve of the spigot (111). When the spigot (111) is opened, as a result of the force of gravity, the fluid can flow from the internal volume (117) through the shaft (203), the channel (209), and the spigot (111) as it is dispensed from the portable water cooler (101), generally in a stream that can be captured or used by a user.

Figure 7:
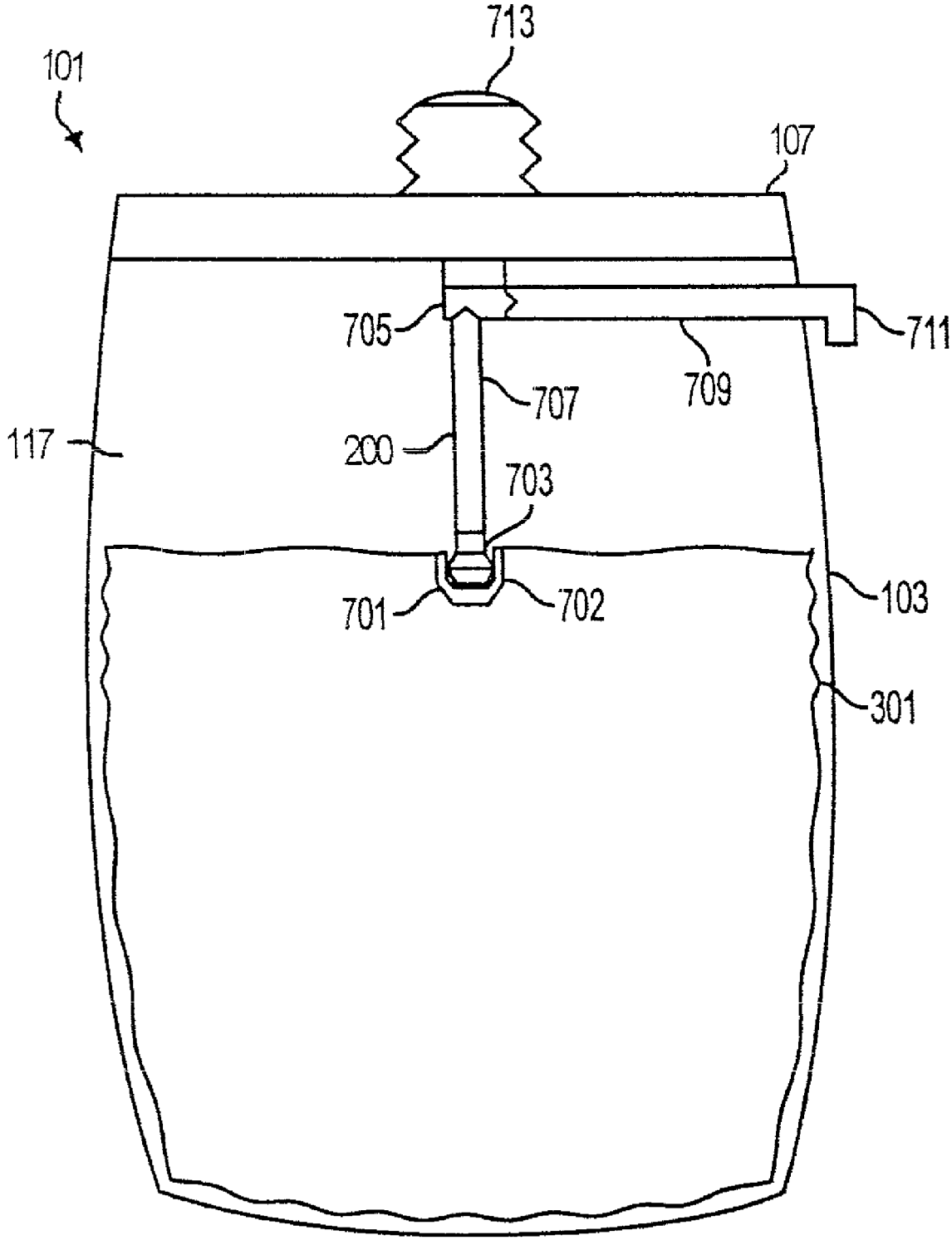
FIG. 7 shows a cross-sectional view of an embodiment of a portable water cooler using a dispensing mechanism in which fluid is pumped out of a bag that is connected to the fluid flow pathway using a two-element fitting.
Figure 8:
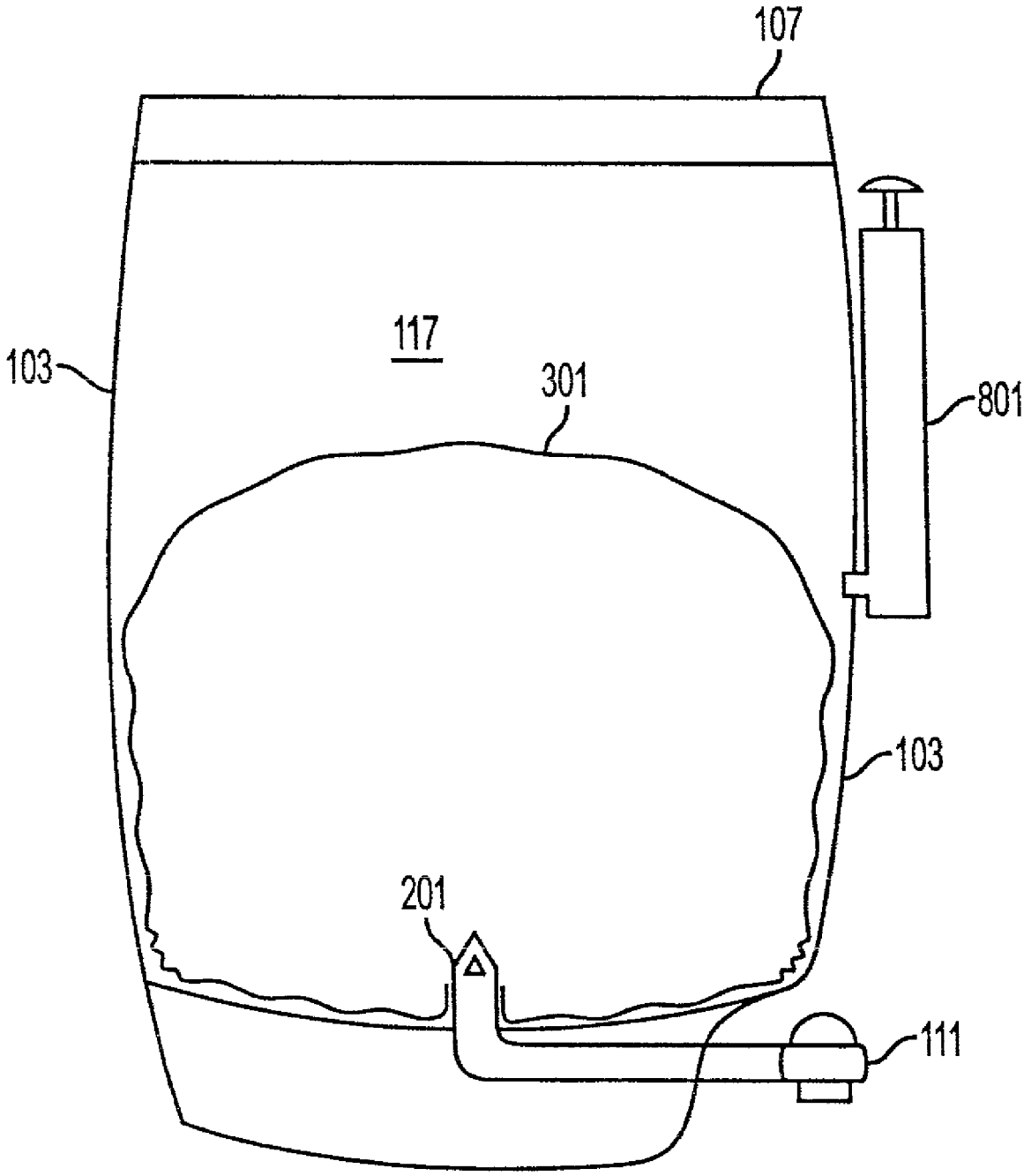
FIG. 8 shows a cross-sectional view of an embodiment of a portable water cooler in which fluid is dispensed from a bag as a result of the internal volume being at higher pressure than the external ambient pressure.

In alternate embodiments, the fluid flow pathway (200) may not be positioned to allow gravity to do the work of dispensing. In such cases, after the fluid is connected to the fluid flow pathway (200) the fluid can be dispensed by other methods. One such method relates to a structure designed to put pressure on the fluid, such as by, but not limited to, pressurizing the internal volume (117) outside of the fluid containing structure. An embodiment of such a structure is shown in FIG. 8. While most of the elements shown in FIG. 8 are similar to those shown in FIGS. 1-3, this embodiment has a pump (801) operatively connected to the exterior of the hollow body (103) and to the internal volume (117) so that a person can pump the pump (801) from exterior to the hollow body (103) and thereby add air pressure to the internal volume (117). As a result of the pressure in the internal volume (117) being higher than the ambient air pressure external to the portable water cooler (101), when the spigot (111) is opened, fluid will flow out until these pressures are equalized. In such an embodiment, the pressure in the internal volume (117) may be any reasonable value. In an embodiment a value in the range of about 1-10 psig is reasonable. In an embodiment having a pressurized internal volume (117), the spigot does not have to be in a particular position relative to the fluid in the internal volume (117) in order to obtain fluid flow out the spigot (111) as gravity need not be used to obtain fluid flow. As such, an alternate embodiment to that shown in FIG. 8 has the spigot at the top of the portable water cooler (101). In a further alternate embodiment, the pump (801) may operate through use of a compressed gas cylinder, such as a carbon dioxide cartridge or any other mechanism designed to increase pressure in the internal volume (117) as known to one of ordinary skill in the art. In a still further structure, a pumping action is used to draw the fluid out of the internal volume (117), such as is shown in FIG. 7, discussed below.

In a preferred embodiment, the fluid containing structure comprises a sealed, flexible bag (301) as illustrated in FIG. 3. Fluid in a bag (301) may be referred to herein as "bagged fluid". The bag (301) may be made of any suitable material, but is preferably made of a plastic material such as an organic polymer sheet material and is preferably flexible and pliable and does not impart a rigid shape to the fluid. The bag (301) may, however, be filled with fluid to a point that the fluid is under pressure, forming a relatively inflexible combination when the bag is sealed. The bag (301) also may be of any suitable construction. Preferably the bag (301) placed in the cooler comprises a single-layer film wall. In an alternate embodiment a bag (301) may be constructed with several plies of material or a set of bags placed one within another. Such a multi-layer bag system may include what is commonly referred to in the art as a secondary containment or an overwrap. For a bag (301) having several layers, one or more of the layers may be removed prior to placing the bag (301) in the portable water cooler (101).

The embodiment of FIGS. 1 and 2 can be used with such a sealed bag of fluid in the following manner. The bag (301) is placed into the internal volume (117) of an upright portable water cooler (101), coming to rest on the bottom end (105)

thereof. In such position, preferably the weight of the of the fluid in the bag (301) is enough to push the outer wall of the bag (301) onto the projecting spike (201) with sufficient force that the blade (205) penetrates the outer wall of the bag (301), granting the spike (201) access to the fluid inside the bag (301). In an alternative embodiment, the bag (301) can be placed into the internal volume (117) of the flexible portable water cooler (101) and pressed onto the blade (205) by another method, such as a force exerted through the hands of the user, in order to puncture the bag (301). Such puncturing by forcing the bag (301) onto the spike (201) may be used in an embodiment of a flexible portable water cooler (101), such as shown in FIG. 6, among other embodiments. The embodiment of FIG. 6 provides for an alternative mechanism for having the spike (210) penetrate the outer wall of the bag (301). In particular, the bag is placed in the internal volume (117), the lid (107) is closed, and the user then forces a portion of the fluid flow pathway (200) including the spike (201) through a hole (609) in the hollow body (103) and into the internal volume (117) also penetrating the outer wall of the bag (301), connecting the fluid flow pathway (200) with the portable water cooler (101) and puncturing the bag (301) in essentially the same motion.

The result of the puncturing of a bag (301) placed in a portable water cooler (101) such as that shown in FIGS. 1, 2 and 6 is depicted in FIG. 3. As shown in FIG. 3, a portion of the structure of the spike (201) projects into the bag (301), thus allowing the fluid in the bag (301) to flow into a hole (207) and through the hollow shaft (203), the channel (209), and out the spigot (111) when the spigot (111) is opened. In this way, fluid in the sealed bag (301) is provided with access to the fluid flow pathway (200) so as to be dispensed, but generally is prevented from contacting the inside walls of the hollow body (103). Once the fluid in the bag (301) has been fully dispensed, the bag (301) is removed and discarded and the portable water cooler (101) can be refilled with another fluid. Some fluid may remain in the bag after fully dispensing from the bag (301), for example, in the bottom of the bag (301), below the level of a hole (207), or otherwise caught in a fold of a collapsed bag (301); but this fluid is presumed to either be purposefully fed into the holes (207) by a user, or simply discarded.

In a preferred embodiment, the interaction of the bag (301) and the spike (201) is such that after the bag (301) is pierced, the opening in the bag (301) seals around the spike (201), thus preventing leakage of any significant amount of fluid from inside the bag (301) into the internal volume (117). Sealing of the bag (301) about the spike (201) is accomplished when the shaft (203) is sized and shaped so that as the wall of the bag (301) is deformed and broken by the blade (205), the integrity of the wall of the bag (301) remains intact around the entire circumference of the spike (201). Generally, the integrity of the bag (301) will remain intact up to the point of contact between the bag (301) and the spike (201), as well as for some length along the spike (201) in a direction generally perpendicular to the circumference thereof (e.g., a cuff (303) as discussed below). In an embodiment, the physical properties of the bag material (e.g., elasticity) promote the sealing of the bag (301) about the spike (201).

In an embodiment such as shown in FIG. 3, the spike (201) includes a cylindrical shaft (203) and a blade (205) that comprises a circular cone positioned at an end of the shaft (203) and having a radius at its base identical to, or slightly smaller than, the largest radius of the shaft (203). In this configuration, as the bag material is punctured by the point of the cone, the opening in the bag (301) is gradually enlarged as the bag (301) is pushed over the cone of the blade (205) and onto the shaft (203). During this puncturing process, the wall of the bag (301) may tend, in effect, to roll inward and upward along the blade (205) and the shaft (203), thus creating a cuff (303) of bag material that rests along a length of the spike (201) all the way around the circumference of the spike (201). Having been forced onto the shaft (203), the opening in the bag (301) is sealed against the shaft (203), the opening in the bag essentially exactly matching the shape and circumference of the shaft (203). To an extent, the seal is aided by pressure exerted by the fluid, tending to push the cuff (303) of the bag against the spike (201).

The exact size and shape of the cone and shaft useful for forming a seal for preventing or sufficiently hindering leaks depends on many factors, including the dimensions of the bag (301), the materials used in the bag's construction, and the type and amount of fluid contained therein, among others. While other sets of parameters also may work well, a set of spike and bag parameters that is particularly well suited to use in an embodiment includes the following: a bag preferably made from a single sheet of polyethylene having a sheet thickness in the range of 1 to 10 mil, preferably from about 3 to about 4 mil, the bag preferably being rectangular in shape and having planar dimensions in the range of about 12-16 inches by about 14-18 inches, most preferably about 14.6 by about 16.6 inches, the bag filled with about 2.4 to about 3 gallons of fluid, preferably with about 2.75 gallons, and sealed with no more than about 100-500 milliliters of air, preferably no more than about 300 milliliters, and a spike having a smooth but unpolished outer surface, having an outer diameter and height no less than about 0.37 inch, preferably having a height and outer diameter in the range of about 0.5-0.7 inch, the spike topped by a blade that is preferably a right circular cone having an angle of expansion in the range of about 30-60 degrees, and more preferably about 35-45 degrees. The angle of expansion as used herein being the angle between two lines lying along the outer surface of the cone and passing through the vertex of the cone, the two lines being opposite sides of an isosceles triangle the base of which is a diameter of the circular base of the cone. Given a spike (201) and bag (303) as just described, the puncturing and subsequent sealing of the bag (303) by the spike (201) is easily accomplished by dropping the bag (301) onto the spike (201) from a height of about six inches.

Generally, for a conical blade (205) as described above, the cuff (303) of a single sheet polyethylene bag will have a length (height) that is fairly constant around the circumference of the shaft (203), and that is about equal to the radius (half the diameter) of the cylindrical shaft (203), since the blade is symmetrical. For a spike (201) with a conical blade (205) and cylindrical shaft (203) and a 3 to 4 mil single sheet polyethylene bag, a cuff (303) of less than about one-quarter inch does not seal as well as do larger cuffs (303). In this regard, bags (301) made of laminate constructions generally do not seal as well as non-laminate constructions because of the likelihood of unsymmetrical cuffs, and in particular, the possibility of crack propagation along a length generally perpendicular to the spike (201), which may compromise the integrity of the wall of the bag (301) a distance away from the spike (201) and allow leakage.

In the embodiment of the portable water cooler (101) shown in FIG. 7, rather than a spike (201), the fluid flow pathway (200) comprises a fitting (701) that creates the joint between the bag (301) and the fluid flow pathway (200). The fitting (701) is comprised of at least two elements (702 and 703) that can be joined to form a fluid-tight connection. In this embodiment, the fluid flow pathway (200) includes an element of a fitting (703) that is designed to allow a fluid-tight connection to a correlating element (702) of the fitting located on the bag (301). An example of such correlating fitting elements is found in threaded pipe or hose joints wherein a female threaded end of one pipe or hose mates to a male threaded end of another pipe or hose. Another example of such a connection is a tapered pressure fitting, more specifically exemplified by a first pipe having a first end with an outer diameter that is tapered along a length to a smaller outer diameter at the first end of the first pipe such that this first pipe can be pushed into and securely fit with a second pipe having an internal diameter intermediate between the smallest and largest outer diameters along the tapered length of the first pipe. Various such connectors (or fittings) using correlating fitting elements are known for use in numerous settings where fluid-tight connections need to be made, including between a bag containing fluid and a fluid flow pathway, and such fittings can be adapted to be used to connect a sealed fluid container such as a bag (301) with a fluid flow pathway (200), such as by manufacturing the bag (301) with a port or an attached hose that includes an element of such a fitting. A specific example of such a fitting for a bagged fluid is provided by Server Products, Inc., headquartered in Richfield, Wis., USA, whose Server Express™ system includes a fitting element that mates with a fitment in a bag, the fitment and bag being produced by Sealed Air Corporation of Saddle Brook, N.J., USA, under the Cryovac® name.

Also shown in the embodiment of FIG. 7, a pump (713) is positioned above the lid (107) of the portable water cooler (101), and is connected through a tube (707) to the bagged fluid at the fitting (701) and also through a channel (709) to the spigot (711). These elements are connected through a valve (705) that allows one-way flow of the fluid from the bag (301) to the spigot (711) when the pump (713) is operated. The embodiment shown uses a fitment or fitting element (702) that is originally sealed inside the bag (301). The fitting element (703) of the fluid flow pathway (200) is a probe that punctures the wall of the bag (301), breaching the bag's seal and connects to the fitment (702) of the bag (301) with a fluid-tight seal. The bag (301) retains its integrity up to its connection with the fitment (702). The connection at the fitting (701) between the fitment (702) and the fitting element (703) maintains the fluid in isolation from the internal volume (117), but allows fluid from the bag (301) to enter the fluid flow pathway (200) and be dispensed from the spigot (711) when the pump (713) operates.

As should be apparent from the above descriptions, whether the bag (301) seals about the spike (201) or is sealed to the fluid flow pathway (200) through a fitting, the fluid in the bag (301) generally is only in surface contact with the interior surface of the bag (301) and the surfaces of the fluid flow pathway (200). In particular, the fluid is not in direct contact with the inner surfaces of the hollow body (103) prior to dispensing. In this way, contaminants, including flavors, from the fluid cannot be directly transferred to the interior surfaces of the hollow body (103) and vice versa. Therefore, even very strongly flavored fluids may be used in the portable water cooler (101) without risk of contamination of the portable water cooler (101) or of a later-dispensed fluid. Further, even where contamination of the surfaces of the hollow body (103) has occurred, a fluid in a sealed bag (301) put into such a contaminated portable water cooler (101) should not pick up any of the contamination since the outer wall of the bag (301) separates the fluid in the bag (301) from the portable water cooler (101) so that the fluid is not in contact with the hollow body (103). Not only are wall-adsorbed contaminants and particulates kept out of the dispensed fluid, but also because of the seal between the bag (301) and the spike (201), no fluid external to the bag (301) can enter the fluid flow pathway (200). Even where there is not a complete seal between the bag (301) and the spike (201), the fluid in the bag (301) will generally have displaced any small amounts of fluid in the internal volume (117) outside of the bag (301), and thereby prevent this contaminant fluid from being dispensed.

Further, where a portable water cooler (101) is generally used with bagged fluid, the internal surfaces of the fluid flow pathway (200) are generally not connected to the interior surfaces of the hollow body (103). If components of the fluid flow pathway (200) were to become contaminated, in an embodiment they can simply be removed and replaced, either as a complete set or individually. This means that once contaminated, a portable water cooler (101) does not need to be completely replaced or even limited in use.

One can see that the ability to segregate the fluid flow pathway (200) of the portable water cooler (101) from the hollow body (103) allows for use of the portable water cooler (101) that was previously not possible. For instance, the portable water cooler (101) can rapidly be switched between two completely different flavors of fluid with only minimal risk of cross contamination, and with only minimal cleaning, if any. Further, the portable water cooler (101) could even be used to transport a non-potable fluid almost immediately followed by a potable fluid, without risk to a consumer of the potable fluid, especially where the fluid flow pathway (200) is replaceable and has been replaced between such uses.

As an example of use with non-potable fluids, boat-based camping often necessitates the use of natural water such as from a lake or river, which is non-potable until boiled or chemically treated to kill harmful microorganisms. A portable water cooler (101) can be used to store untreated lake water, either directly or in a bag, and to dispense the lake water through an embodiment of a fluid flow pathway (200) or a prior art dispensing mechanism. If the a source of potable water later becomes available, the same portable water cooler (101) can be used for storage and dispensing thereof simply by putting the potable water in a bag (301) and cleaning or replacing the fluid flow pathway (200), if necessary, or retrofitting the portable water cooler (101) on the spot. Such a use allows boat campers to carry only a single portable water cooler (101)—which can be particularly important when space is limited such as on a camping trip—the components of a second fluid flow pathway (200), and a collection bags.

In addition to new uses for a portable water cooler (101), the bag (301) and portable water cooler (101) combination is also more sanitary. There is no need to penetrate the seal of a bag (301) prior to preparing to use the fluid contained therein, and even after the seal has been breached, and even with the internal volume (117) of the portable water cooler (101) open to the external environment (e.g., while the lid (107) is removed), debris can generally not get into the fluid as the fluid is essentially still in a sealed system. Accordingly, a bag (301) can be prefilled with fluid in a sanitary manner, transported to a second location, placed in the portable water cooler (101), and dispensed with little risk of contamination from the second location. Further, the chance of fluid loss from spillage (such as in a vehicle) can also be minimized since the fluid is maintained in a sealed system inside the portable water cooler (101), which is also more sanitary.

Generally, the bag (301) may be filled with any fluid which is desired to be dispensed. In an embodiment, the fluid is pre-filled into the bag (301) and the bag (301) is presealed prior to transfer to the consumer. In such a case the fluid may be water or it may be a premixed flavored drink such as a combination of a powdered soft drink mix and water, a juice, or a manufactured beverage. In another embodiment the bagged fluid may be provided as a bag that includes a pre-measured amount of liquid or solid drink mix concentrate with the intention that the user add water to make the flavored drink. In either case, the bag may be designed to be filled with liquid and then sealed by any means known to those of ordinary skill in the art, including a reclosable seal such as a threaded seal or a zipper-type seal, or a permanent or semi-permanent seal such as an adhesive or heat treated seal. This seal may comprise the fitment (702) in an embodiment. Also in either case, the bags (301) of fluid may be provided to the consumer separately from the portable water cooler (101). In comparison to traditional bottled or canned drinks, the fluid-filled bag can allow for improved manufacturing and decreased shipping cost, the later potentially resulting from either improved space utilization in the shipping process or reduced packaging weight.

In another embodiment, there is provided an empty bag (301) and a separate vessel of powdered, concentrated, or other type of drink mix. The vessel of drink mix is preferably sized to flavor an amount of liquid that is designed to be held by the bag (301). Therefore, to prepare a container that embodies the present invention filled with flavored fluid, a user would purchase the container, purchase a bag (301) and mix kit of the appropriate size and of the desired flavor, prepare the mix in the bag (301) and seal the bag (301). The user may then refrigerate or otherwise alter the temperature of the bag (301), if desired, and place the bag (301) inside the container.

Figure 4:
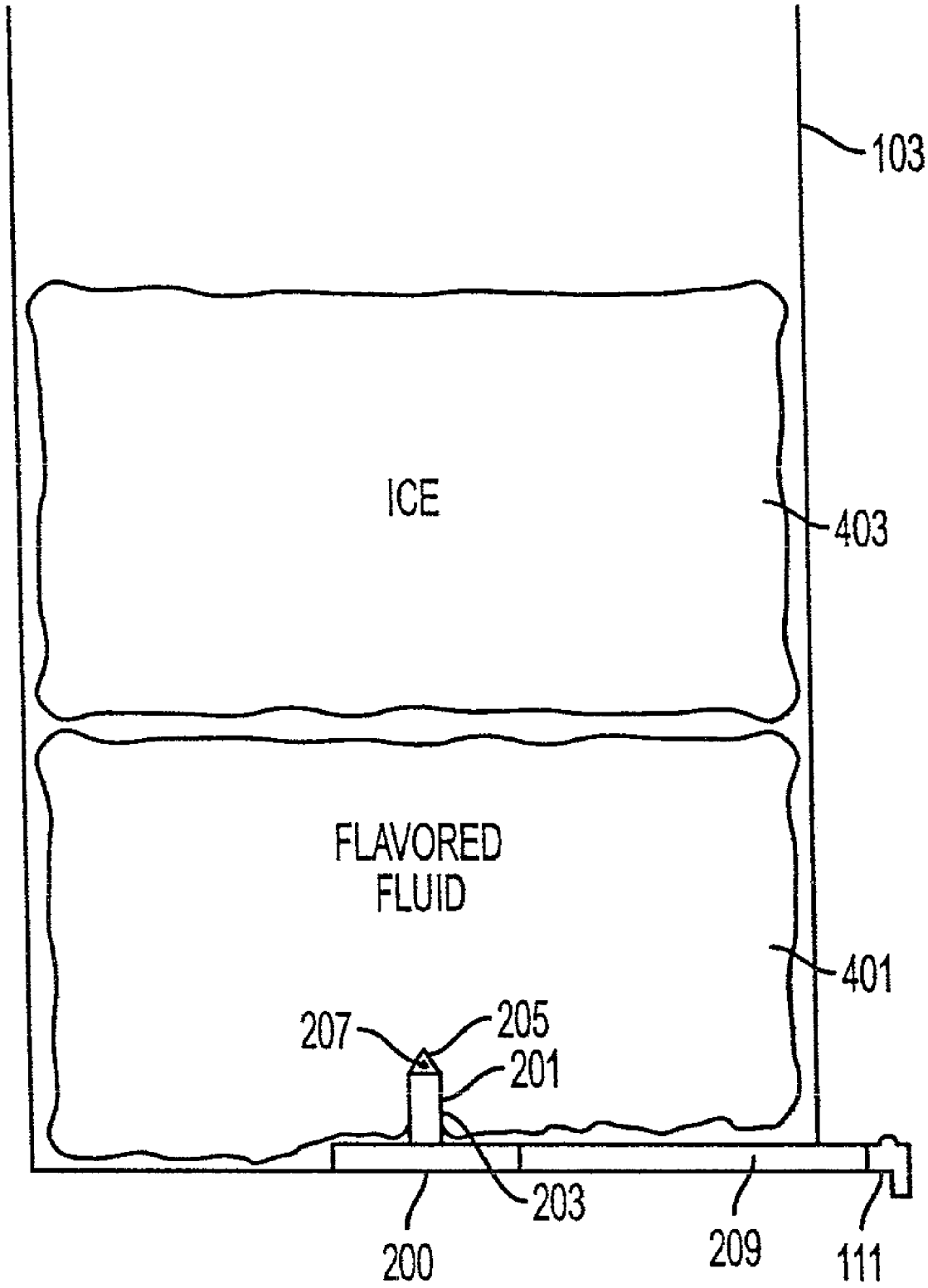
FIG. 4 shows a cross-sectional view of a two bag system for use with an embodiment of a portable water cooler.
Figure 5:
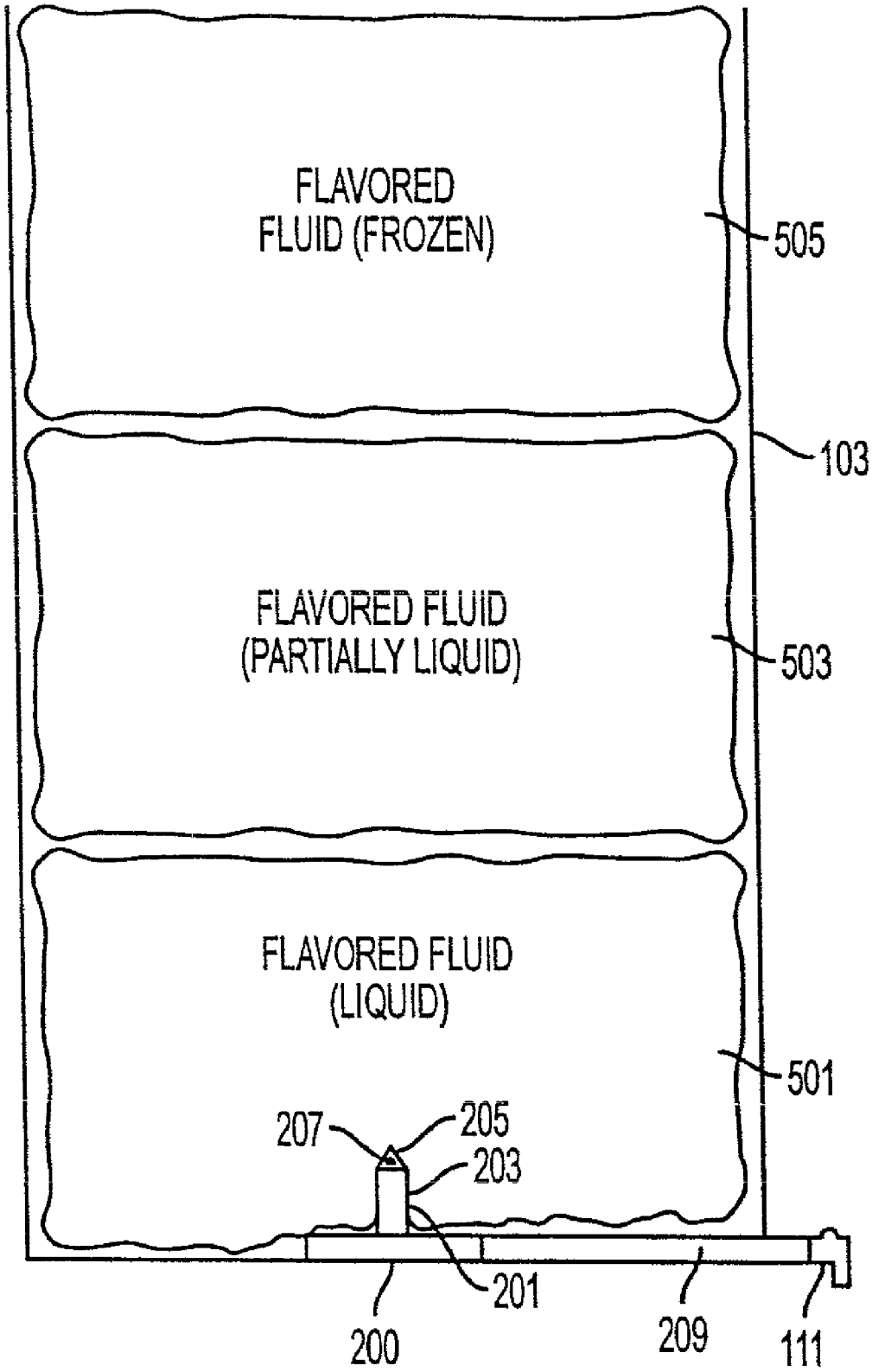
FIG. 5 shows a cross-sectional view of a staged, multi-bag system in an embodiment of a portable water cooler.

In another embodiment, fluid provision from the portable water cooler (101) can be improved through the inclusion of an ice bag or second flavor bag in the internal volume (117). The use of such a multi-bag kit is shown in the embodiments of FIGS. 4 and 5. In such a use, the user obtains a first bag (401) of fluid and a second bag (403) filed with fluid or ice, or filled with a fluid and then frozen in the bag (403) (generally in a mold to insure the frozen block fits within the portable water cooler (101)). Both bags are then placed in the portable water cooler (101) one on top of the other. If the second bag (403) contains ice, it will generally be placed on top of the first bag (401) within the portable water cooler (101), in order to allow access to fluid in the first bag (401) via the spigot (111). Where the second bag (403) contains ice, the melting ice will cool the fluid in the first bag without diluting it. Further, once the fluid in the first bag (401) has been fully dispensed, the first bag (401) can be removed and the second bag (403) can be put back into the portable water cooler (101) and now penetrated by the spike (201) to allow dispensing of the melted ice. Alternatively, in another embodiment, neither the first bag (401) nor second bag (403) is removed after fully dispensing from the first bag (401), but rather the weight of the second bag (403) forces the second bag (403) onto the spike (201) to allow dispensing therefrom. An embodiment with three bags using flavored ice is shown in FIG. 5 where three bags (501), (503), and (505) all contain flavored fluid in various different stages of thaw. This embodiment can be used much like the two bag system but with greater versatility.

The multi-bag system can provide an increased versatility and selection for a single portable water cooler (101), which previously has been limited generally to use with a single fluid. Using the multi-bag system, the user can simultaneously carry two different flavors of fluid to be used one after the other. This style of use can clearly be expanded by carrying a plurality of fluid-filled bags a single cooler. Further, the bags can be arranged so that once one bag is emptied, in whole or in part, a next bag in sequence is automatically spiked, or can be arranged to prevent that action if the user so desires, such as by placing a divider between bags that is impenetrable by the spike (201).

In an embodiment of either the multi-bag or the single bag system, the bag may be placed in a mold or on a mold to provide a shape to the fluid and bag as the fluid is frozen. In this way, the bag of frozen fluid can be of a predetermined shape to provide for easier insertion into the portable water cooler (101). This mold may either be designed to be inserted with the fluid bag into the portable water cooler (101), or the bag may be removed from the mold once the fluid has frozen. Generally, the mold will match the shape of the internal volume (117) of the portable water cooler (101), or a portion thereof, but that is by no means required and other shapes may be used. In a still further embodiment, shaped bags can be used to provide a desired shape to the frozen fluid.

While the invention has been disclosed in connection with certain preferred embodiments, the elements, connections, and dimensions of the preferred embodiments should not be understood as limitations on all embodiments. Modifications and variations of the described embodiments may be made without departing from the spirit and scope of the invention, and other embodiments should be understood to be encompassed in the present disclosure as would be understood by those of ordinary skill in the art.

The invention claimed is:

1. A portable water cooler comprising:

a hollow body including:

side walls; and a base;

wherein said base is configured for resting on a surface;

wherein said hollow body is comprised of a plurality of layers, at least one layer in said plurality being a thermally insulating layer; and wherein said side walls and said base define an internal volume;

a fluid flow pathway connecting said internal volume to the space external to said hollow body, said fluid flow pathway comprising:

a spike comprising:

a generally cylindrical elongated hollow shaft having a first end, a second end, and a circumference;

a conical point attached to said first end of said shaft and having a circumference generally equal to said circumference of said shaft; and at least one opening into which fluid can flow, said spike immovably positioned within said interior volume and extending generally vertically from said base;

a spigot positioned external to said hollow body at a position above said base when said base is resting on said surface; and an enclosed channel connecting said second end of said shaft to said spigot; and at least two flexible bags containing fluid and positioned in said internal volume wherein said at least one of the at least two flexible bags is positioned such that after fluid from another flexible bag has been dispensed, the wall of said at least one of the at least two flexible bags will be penetrated by said spike.

2. The apparatus of claim 1 wherein said hollow body has a rigid form.

3. The apparatus of claim 1 wherein said conical point is a right circular cone having an angle of expansion in the range of about 30 to about 60 degrees.

4. The apparatus of claim 1 wherein said at least two flexible bags are constructed of a single ply of polyethylene having a thickness in the range of about 3 to about 4 mil.

5. The apparatus of claim 1 wherein at least a portion of said fluid flow pathway is repeatably removable and replaceable.

6. The apparatus of claim 1 wherein at least one of the at least two flexible bags contains a frozen liquid.

7. The portable water cooler of claim 1 wherein the shape of said hollow body is generally that of a cylinder that is closed on a first of two ends by said base.

8. The portable water cooler of claim 7 wherein said generally cylindrical hollow body is open on the other of said two ends and has a repeatably removable lid that can be positioned at said open second end so as to enclose said internal volume.

9. The portable water cooler of claim 8 wherein said internal volume is in the range of about 2 to about 10 gallons.

* * * * *